United States Patent [19]

Kerridge

[11] Patent Number: 4,461,655

[45] Date of Patent: Jul. 24, 1984

[54] FUSED SALT BATH COMPOSITION

[75] Inventor: David H. Kerridge, Salisbury, England

[73] Assignee: National Research Development Corporation, London, England

[21] Appl. No.: 469,128

[22] Filed: Feb. 23, 1983

[30] Foreign Application Priority Data

Feb. 23, 1982 [GB] United Kingdom ..... 8205348

[51] Int. Cl.[3] ..... C23C 9/12

[52] U.S. Cl. ..... 148/15.5; 148/15; 148/28

[58] Field of Search ..... 148/6.11, 15, 15.5, 148/28, 30

[56] References Cited

FOREIGN PATENT DOCUMENTS 174000 3/1979 Hungary .

2054660 2/1981 United Kingdom .

*Primary Examiner*—Evan K. Lawrence

*Attorney, Agent, or Firm*—Cushman, Darby & Cushman

[57] ABSTRACT

A non-cyanide salt composition for use in a fused-salt metal heat treatment bath for carburizing steel contains, as its cations, on the basis of total moles of cations 23 mole % potassium, 4½% lithium, and the balance substantially sodium, and contains, as its anions, on the basis of total moles of anions 19 mole % chloride and the balance substantially carbonate (precursors of any of these ions counting as the ion). The liquidus temperature of the overall composition is not more than 750° C. The composition further contains 1 to 40 weight % silicon carbide based on the total weight of the anions and cations. A steel component is typically treated with the salt composition at 920° C. for 4 hours.

10 Claims, No Drawings

FUSED SALT BATH COMPOSITION

The present invention relates to a fused salt bath composition.

Heat treatment of metals in fused salt baths is a well established method of obtaining desired properties for a metal to suit its particular end use. One example of such a heat treatment is the case carburisation of steel.

It is known to case carburise mild steel components in molten cyanide baths obtained by fusing sodium (or potassium) cyanide and sodium (or potassium) carbonate (optionally together with a melting point depressant such as sodium or potassium chloride). The surface of the component to be treated is simply immersed in the bath, the carburisation being effected by a carburising species generated within the melt. Cyanide baths however have severe drawbacks, for example the high cost of the sodium or potassium cyanide which must continually be added to the bath, and the production of noxious cyanide-containing waste products, including a sludge which forms at the bottom of the bath, water with which the carburised components have been washed and exhausted salts.

An alternative to the fused cyanide bath is a fused salt bath containing solid silicon carbide in a melt of sodium or potassium carbonate (or alternatively an alkaline earth metal carbonate) which optionally additionally includes a melting point depressant such as sodium chloride or potassium chloride. In this case the carburising species is believed to be generated by reaction between the silicon carbide and the carbonate ions.

However it is found that such baths rapidly become unworkable due to the formation of a thick silicate crust on the melt surface. This vitiates the advantages of silicon carbide, namely lack of toxicity and cheapness.

I have therefore proposed a fused salt bath composition in GB Specification No. 2054660 containing 10 weight % silicon carbide, 4% lithium carbonate and the balance an equimolar mixture of sodium carbonate and potassium chloride. It appears that the lithium ions can prevent encrustation of the melt surface, and that they cause silicate (formed from the silicon carbide) in the bath to cystallise out as needles on cooling, whereby such silicate, which is unwanted, can be easily removed, such as by sieving. Lithium salts are, however, expensive.

The chloride used in this mixture is for the purpose of reducing the melting point, but large amounts of chloride are now found to increase the hardness of the crust on the bath. Besides being hard, such a crust is also tough (not brittle) and difficult to break when cold.

According to the present invention, a salt composition for use in fused-salt metal heat-treatment baths contains, as its cations, 20–30 mole % potassium, 3½–5½ (preferably 4–5) mole % lithium and the balance substantially sodium, and contains, as its anions, up to 25 mole % (preferably 10–25, more preferably 15–22 mole %) chloride and the balance substantially carbonate (precursors of any of these ions counting as the ion), subject to the liquidus temperature of the overall composition being not more than 750° C., the composition further containing based on the total weight of the cations and anions 1 to 40 (preferably 2 to 10) weight % silicon carbide As used herein the basis for the mole percents of cations is the total moles of cations; similarly basis for the mole percents of anions is the total moles of anions.

Examples of carbonate ion precursors are ions which decompose or oxidise to carbonate at the temperature of the melt, e.g. bicarbonate, formate, acetate and oxalate.

The salt composition may be in the form of premixed pellets of regular mass. Supplied in such a form, the salt composition need not be weighed out or mixed, but can be added to a heat-treatment bath by number (simpler and more reliable than adding the individual components by weight).

It is possible to use any grade of silicon carbide in the process of the invention. The amount of silicon carbide used will depend on a number of factors which are discussed below.

The fused salt bath may be used for case carburising metal, particularly steel components, or may be operated as a "neutral" bath. A "neutral" bath is one which gives no case carburisation and merely thermally treats the metal surface. In this case, the amount of silicon carbide used in the bath will be such that there is no increase in the carbon content of the surface layer of the metal part.

If the bath is to be operated as a carburising bath then the amount of silicon carbide must be above a certain minimum amount otherwise the bath will either function as a neutral bath or may even be decarburising with respect to steel to be treated.

The optimum weight percentage of the silicon carbide will however vary with its particle size, particle size range, and also the treatment temperature. As an example, it has been found that about 5% by weight (same basis as above) at 20–60 grit in the metallurgical grade seem optimal at 920° C., although 4–4½% 20–40 grit in the metallurgical grade and 12, 24, 60 and 80 grits in the first quality grade have been found satisfactory when used in respective amounts of 30%, 20%, 10% and 10% (generally 2–40%) at temperatures of 850°–920° C. Also, 1½% by weight seems optimal both for 60–120 grit and 120—finer (i.e. smaller particles than 120 grit) at 920° C., with somewhat less at 950° C., and somewhat more (1¾–2%) at 850° C. The grit sizes are to FEPA standards (Federation of European Producers of Abrasive Products).

The time for which the metal is carburised in the bath will depend on the temperature thereof as well as the required depth of carburisation. It is most preferred that the bath be operated at a temperture of 850°–950° C. since lower temperatures, e.g. 800° C., may give slow carburisation and higher temperatures, e.g. 1100° C., may give carburisation which is impractically fast. A typical treatment time at 920° C. would be about 2 hours, but times of ¼–24 hours have been used.

In use, the bath composition will become gradually depleted in silicon carbide and for most effective operation the bath would be topped up daily with 1–6% of silicon carbide and a small quantity such as 5–20% of the salt formulation. The bath can be operated continuously over a period of several weeks, but it is generally preferable to cool the bath (emptied of metal to be carburised) every 24 hours to well below its operating temperature, e.g. to 850° C. or 800° C. if operating at 920° C., and to dredge the bath every 12 hours. The cooling is to precipitate silicate (as lithium silicate needles), this silicate being formed continuously as a by-product from the silicon carbide. If the silicate were not precipitated out at intervals, its concentration in the bath would rise to saturation at the operating temperature, whereafter it would form precipitate particles either in the melt, lodging on metal pieces being carburised, or on cold metal pieces as they are introduced into the bath, in both cases interfering with the carburisation.

The dredging is to remove sludge formed at the bottom of the bath, and also the precipitated silicate, so that these do not hinder the working of the process.

The invention is now described by way of example. A salt bath had the following composition:

| | | |
|---|---|---|
| Sodium carbonate | | 68 weight % |
| Potassium chloride | | 14½ weight % |
| Potassium carbonate | | 14½ weight % |
| Lithium carbonate | | 3 weight % |
| | | 100 weight % |
| Silicon carbide (60–120 grit): | | 2 additional weight % |
| In mole terms, this is: | | |
| sodium | 72½% | carbonate 81% |
| potassium | 23% | chloride 19% |
| lithium | 4½% | |

The liquidus temperature of this composition was found to be 710° C.

A steel component (EN1A steel) was fully immersed in this bath, which was held at 920° C. It was found that, after one hour, carburisation to a discernible degree had penetrated 0.55 mm from the steel surface, the upper 0.22 mm being fully pearlitic; after 3½ hours, these depths were 0.80 mm and 0.44 mm respectively. The hardness profile after 4 hours was 890 on the outside, 960 at 0.2 mm. 908 at 0.3 mm and 810 at 0.4 mm, all values in VPN (Vickers Pyramid Numbers) determined with 50 kg load which, as will be appreciated, penetrates considerably and so responds to layers below the nominal depth in question.

Fresh salt is added at the rate of 10 weight % daily, and silicon carbide at the rate of 2 weight % (based on the salt) per 8 hour day (¼% hourly). After idling the bath overnight at 750° C., an addition of only ⅓% silicon carbide was adequate to restore the bath to full carburising potential. With some known formulations, the silicon carbide tends to react more or less completely (to silicate) during overnight idling.

Sludge crystals—mostly silicate—are removed at the rate of approximately 7 weight % daily (based on the salt), an operation which can be as quick as 10 minutes. The removal of sludge by using a perforated scoop can lower the bath temperature by as much as 50° C. Therefore the low liquidus of this composition gives a valuable latitude in temperature control and in preventing crystallisation of the salt components, which would lead to their unnecessary and expensive removal. This is all the more important when components to be carburised are suspended in the bath from rods passing into the bath: these rods can have a considerable cooling effect. Also, where it is expedient to fill the bath nearly to the brim, upper regions of the bath may well be cooler than intended, thus making it prudent to use a salt composition with a low liquidus.

Despite this cooling, the bath has a consistently soft crust compared with that of the known carbide/carbonate bath mentioned earlier. This crust can be broken without too much difficulty even when cold, and does not present an obstacle to regular operation. But for the chloride, the crust would not be excessively hard in the first place, but its value as a melting point depressant, with all the advantages of latitude in temperature control, outweighs this problem. This problem is believed to be considerably reduced by the presence of lithium, which induces any silicate formed (which would otherwise tend to migrate to the crust) to crystallise in the melt where, as described, it is amenable to being sieved out.

This bath appears to have a life of at least four weeks in daily use with replenishment and sludge removal as specified.

I claim:

1. A salt composition for use in a fused-salt metal heat treatment bath containing, as its cations, 20–30 mole % potassium 3½–5½ mole % lithium, and the balance substantially sodium, and containing, as its anions, up to 25 mole % chloride and the balance substantially carbonate, provided that precursors of any of these ions count as the ion, the basis for the mole percents of cations being the total moles of cations and the basis for the mole percents of anions being the total moles of anions, and further provided that the liquidus temperature of the overall composition is not more than 750° C., the composition further containing 1 to 40 weight % silicon carbide based on the total weight of said cations and anions.

2. A salt composition according to claim 1, wherein 4–5 mole % of the cations are lithium.

3. A salt composition according to claim 1, wherein 10–25 mole % of the anions are chloride.

4. A salt composition according to claim 3, wherein 15–22 mole % of the anions are chloride.

5. A salt composition according to claim 1, wherein the amount of the silicon carbide is 2 to 10 weight %.

6. A salt composition according to claim 1, in the form of premixed pellets of regular mass.

7. A method of heat treating metal, comprising treating a metal article in a bath of a fused salt composition according to claim 1.

8. A method according to claim 7, wherein the temperature of the bath is 850°–950° C.

9. A method according to claim 8, wherein the article is of steel.

10. A method according to claim 9, wherein the bath is carburising to the steel.

* * * * *